US012358747B2

(12) United States Patent
Neudel et al.

(10) Patent No.: US 12,358,747 B2
(45) Date of Patent: Jul. 15, 2025

(54) DEVICE FOR STACKING FLAT ITEMS

(71) Applicant: GIESECKE+DEVRIENT CURRENCY TECHNOLOGY GMBH, Munich (DE)

(72) Inventors: Frank Neudel, Freising (DE); Xaver Thum, Wolfratshausen (DE); Wolfgang Koniger, Karlsfeld (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 18/554,034

(22) PCT Filed: Apr. 7, 2022

(86) PCT No.: PCT/EP2022/025135

§ 371 (c)(1),
(2) Date: Oct. 5, 2023

(87) PCT Pub. No.: WO2022/214223

PCT Pub. Date: Oct. 13, 2022

(65) Prior Publication Data

US 2024/0367936 A1 Nov. 7, 2024

(30) Foreign Application Priority Data

Apr. 8, 2021 (DE) ..... 10 2021 001 817.6

(51) Int. Cl.
*B65H 29/40* (2006.01)
*B65H 29/70* (2006.01)

(52) U.S. Cl.
CPC ..... *B65H 29/40* (2013.01); *B65H 29/70* (2013.01); *B65H 2301/51214* (2013.01); *B65H 2404/659* (2013.01); *B65H 2801/72* (2013.01)

(58) Field of Classification Search
CPC ..... B65H 29/40; B65H 29/38; B65H 29/22; B65H 29/70; B65H 2301/51214;
(Continued)

(56) References Cited

U.S. PATENT DOCUMENTS 4,522,387 A * 6/1985 Leuthold ..... B65H 29/40 271/187
6,270,073 B1 * 8/2001 Landwehr ..... B65H 29/40 414/189

(Continued)

FOREIGN PATENT DOCUMENTS

DE 1213859 B 4/1966
DE 3232348 A1 3/1984

(Continued)

OTHER PUBLICATIONS

International Search Report from corresponding PCT Application No. PCT/EP2022/025135, Aug. 19, 2022.

*Primary Examiner* — Luis A Gonzalez
(74) *Attorney, Agent, or Firm* — Workman Nydegger

(57) ABSTRACT

A device for stacking flat items has stacking wheels which have stacking fingers and, located between the stacking fingers, compartments for receiving flat items to be stacked, a conveying device for conveying the flat items into the compartments of the stacking wheels, a stripper for removing the flat items from the compartments of the stacking wheels, a support for receiving the flat items removed from the compartments of the stacking wheels and for forming a stack of flat items, in which at least one first stacking wheel mounted on a first shaft and at least one second stacking wheel mounted on a second shaft are provided.

9 Claims, 3 Drawing Sheets

(58) Field of Classification Search
CPC ..... B65H 2404/659; B65H 2404/652; B65H 2404/653; B65H 2404/654; B65H 2404/656; B65H 2404/657
See application file for complete search history.

(56) References Cited

U.S. PATENT DOCUMENTS

| | | | | |
|---|---|---|---|---|
| 6,494,448 | B2 | 12/2002 | Duhamel et al. | |
| 2001/0020768 | A1 | 9/2001 | Duhamel et al. | |
| 2015/0061221 | A1* | 3/2015 | Haberstroh ..... | B65H 29/22 271/315 |
| 2022/0216502 | A1 | 7/2022 | Bohm et al. | |
| 2022/0223919 | A1 | 7/2022 | Bohm et al. | |

FOREIGN PATENT DOCUMENTS

| | | | |
|---|---|---|---|
| DE | 19757421 | A1 | 7/1999 |
| JP | 2001247243 | A | 9/2001 |
| WO | 2007068887 | A1 | 6/2007 |
| WO | 2020212316 | A1 | 10/2020 |
| WO | 2020212317 | A1 | 10/2020 |

* cited by examiner

DEVICE FOR STACKING FLAT ITEMS

BACKGROUND

The invention relates to a device for stacking flat items.

The stacking of flat items, e.g., electrode elements, is known. In such cases, at least one first electrode element and one second electrode element are used and are arranged at a stack position, thus creating an electrode stack. Electrode elements for producing electrochemical energy stores, such as lithium-ion batteries, or energy converters such as fuel cells, are usually stacked in this way, in particular in the production of pouch cells, a widely used design of a lithium-ion rechargeable battery.

The electrode elements are usually designed as a cathode, based for example on aluminum foil, and/or an anode, based for example on copper foil. The smallest unit of each lithium-ion cell consists of two electrodes and a separator which separates the electrodes from one another. Later, after filling, an ion-conductive electrolyte is located therebetween.

During the stacking process, the electrode elements are stacked in a repeating cycle of anode, separator, cathode, separator and so on.

In addition to the remaining steps of the production of electrochemical energy stores or fuel cells, for example the assembly or the contacting, the step of stacking often represents the bottleneck for manufacturing throughput during production.

Known methods for stacking the electrode elements rely on a gripping arm of a robot, which grips and positions the electrode element. However, according to current knowledge, no significant speed increases are to be expected here.

For stack formation, further known methods rely on a rotating stacking wheel by means of which the electrode elements are placed on an electrode stack.

In this regard, WO 2020/212316 A1 describes a method for producing an electrode stack of anodes and cathodes for a lithium-ion battery of an electrically driven motor vehicle, in which the anodes and the cathodes are conveyed in compartments of a rotationally driven or rotationally drivable stacking wheel, and the anodes and cathodes accommodated in the compartments are conveyed to a support by rotating the stacking wheel. Furthermore, it is known from WO 2020/212317 A1 to stack what are known as D cells. This is an electrode composite composed of an anode and a cathode and separators for separating the electrodes.

To produce the electrochemical energy stores or energy converters, it is necessary to stack flat items, specifically electrodes or D cells, which are not very flexible and are sensitive to damage. This leads to problems if, as in the known prior art, stacking wheels are used to brake the high conveying speed at which the electrodes or D cells are conveyed into the compartments of the stacking wheel. For this purpose, in the known stacking wheels, relatively highly curved compartments are provided which deform the flat items to be stacked during insertion into the compartments, thereby producing the desired braking effect. As a result of the mechanical action in the compartments of the stacking wheel on the flat items or the edges thereof, these can become damaged, however. Due to the low flexibility and the relatively strong curvature of the compartments, it can also be the case that the flat items cannot be inserted completely or quickly enough into the compartments of the stacking wheel, for which reason faults occur in the stacking of the flat items.

SUMMARY

It is therefore the object to provide a device for stacking flat items, by means of which flat items can be stacked by means of a stacking wheel without the aforementioned disadvantages.

The device according to the invention for stacking flat items has stacking wheels which have stacking fingers and, located between the stacking fingers, compartments for receiving flat items to be stacked, a conveying device for conveying the flat items into the compartments of the stacking wheels, a stripper for removing the flat items from the compartments of the stacking wheels, a support for receiving the flat items removed from the compartments of the stacking wheels and for forming a stack of flat items, in which at least one first stacking wheel mounted on a first shaft and at least one second stacking wheel mounted on a second shaft are provided, wherein the shafts of the stacking wheels are parallel to each other in an axial direction and arranged at a distance d from each other so that a central point of the first shaft and a central point of the second shaft lie in a plane, wherein the first stacking wheel and the second stacking wheel are driven at the same speed and in the same rotational direction so that a resultant opening between the first and second compartments is created depending on the angular position of the first and second stacking wheels, wherein portions of the opening between the first and second compartments, which in the respective angular positions are perpendicular to the plane, are constricted by the distance d, whereas portions of the opening between the first and second compartments which are parallel to the plane are unchanged.

The invention is based on the knowledge that arranging the first and second shaft with the first and second stacking wheels at an offset by a distance d results in a variation of the opening geometry established between the first and second compartments of the first and second stacking wheels which is the same for each of the compartments when the stacking wheels complete a full revolution.

The advantage of the invention can be considered the fact that it is thus possible to convey a flat item to be stacked into the compartments of the first and second stacking wheels, with a large resultant opening at the outer circumference of the stacking wheels. As the stacking wheels rotate further, the opening geometry resulting between the compartments of the stacking wheels changes in such a way that the opening is constricted and the flat item conveyed therein can thus be braked and/or clamped. After a rotation of 180°, the opening geometry between the compartments of the stacking wheels again has a large resultant opening, so that the flat item can be removed from the compartments of the stacking wheels without much resistance.

BRIEF DESCRIPTION OF THE DRAWINGS

Further advantages of the present invention result from the dependent claims and the following description of an embodiment with reference to drawings.

In the figures.

DETAILED DESCRIPTION OF VARIOUS EMBODIMENTS

Figure 1:
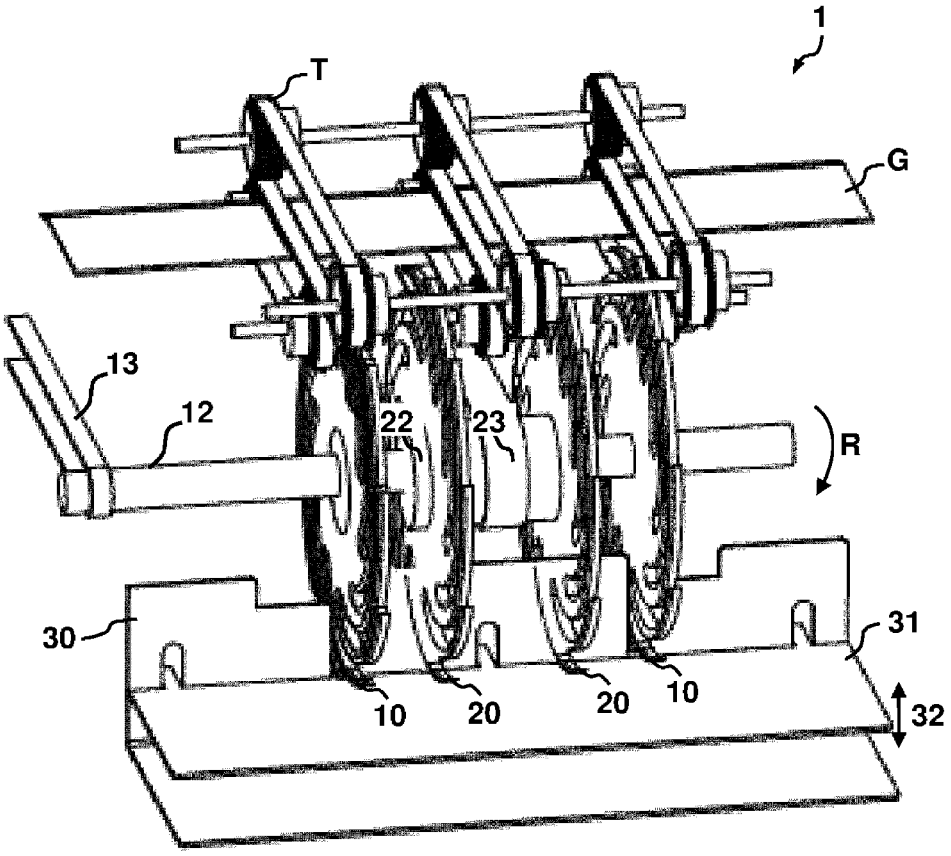
FIG. 1 shows an embodiment of a device for stacking flat items in a three-dimensional view.
Figure 2:
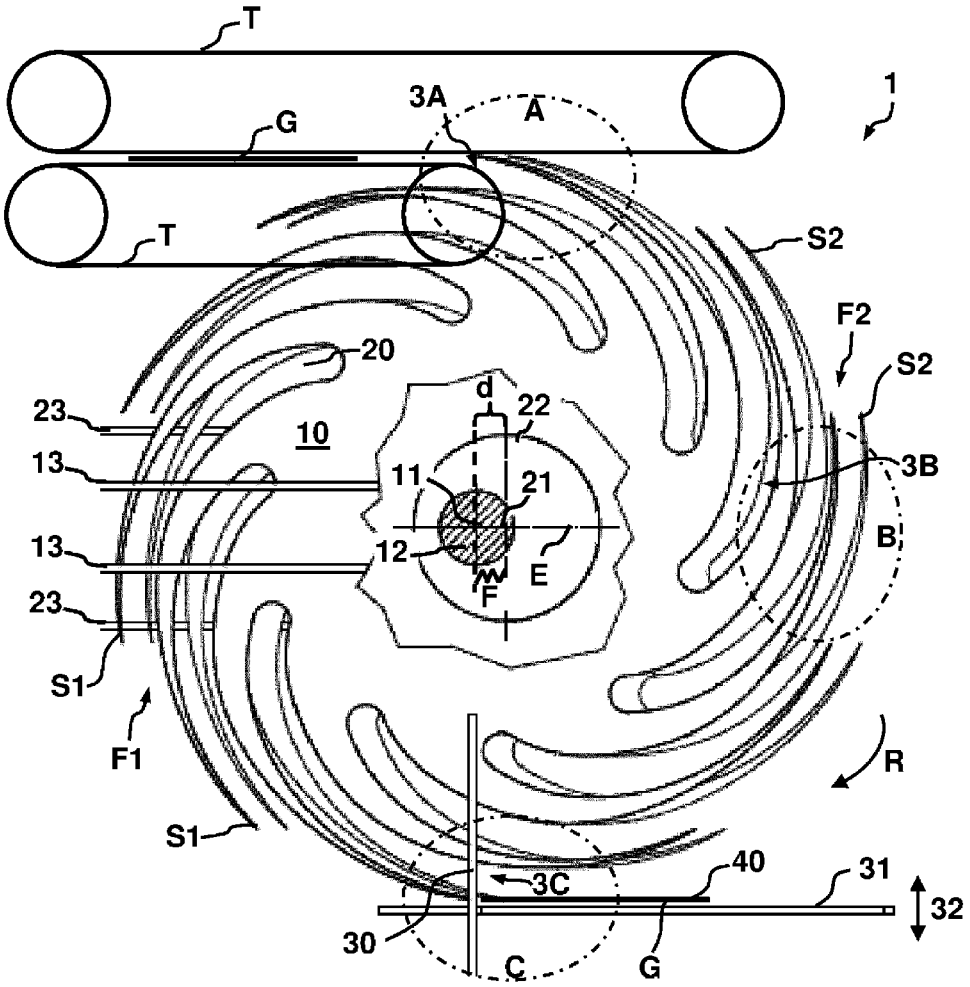
FIG. 2 shows the device for stacking flat items from FIG. 1 in a side view.

FIGS. 1 and 2 show an embodiment of a device 1 for stacking flat items G for forming a stack of flat items by means of at least one first stacking wheel 10 and at least one second stacking wheel 20.

The two illustrated first stacking wheels 10 are mounted on a first shaft 12, which is driven, for example, via a toothed belt 13 and drives the first stacking wheels 10 in a rotational direction R at a predetermined rotational speed. The two illustrated second stacking wheels 20 are mounted on a second shaft 22, which is driven, for example, via a toothed belt 23 and drives the second stacking wheels 20 in a rotational direction R at a predetermined rotational speed, the rotational direction R and rotational speed of the first and second shaft 12, 22 being the same.

The illustrated first and second stacking wheels 10, 20 have a predetermined number of stacking fingers S1 and S2, respectively, in the example shown, ten. Adjacent stacking fingers S1 and S2 enclose a compartment F1 and F2, respectively, according to the predetermined number, in the example shown, ten. The two first stacking wheels 10 are mounted on the first shaft 12 in such a way that the ten first compartments F1 are aligned with one another, i.e., the first stacking fingers S1 and the first compartments F1 of the two first stacking wheels 10 are oriented such that they are congruent when viewed in the axial direction with respect to the first shaft 12. The two second stacking wheels 20 are also mounted on the second shaft 22 in such a way that the ten second compartments F2 are aligned with one another, i.e., the second stacking fingers S2 and the second compartments F2 of the two second stacking wheels 20 are oriented such that they are congruent when viewed in the axial direction with respect to the second shaft 22.

The two shafts 12, 22 of the device 1 are arranged parallel to one another in the axial direction. Central points 11 and 21 of the first shaft 12 and of the second shaft 22, respectively, lie in a plane E and have a distance d from one another.

As described above, the two stacking wheels 10 and 20 are mounted on the first and second shaft 12 and 22, respectively, in such a way that the compartments F1 and F2 are aligned with one another. The same also applies to the first compartments F1 of the first two stacking wheels 10 in relation to the second compartments F2 of the two second stacking wheels 20, i.e., the first and second stacking wheels 10 and 20 are arranged on the first and second shaft 12 and 22, respectively, in such a way that, without the distance d between the central points 11 and 21 of the first and second shaft 12 and 22, respectively, all the stacking fingers S1, S2 and all the compartments F1, F2 of all first and second stacking wheels 10, 20 are oriented in such a way that they are congruent in the axial direction as viewed with respect to an imaginary common axis.

If the two shafts 12, 22, as described above, are driven with the same rotational speed and rotational direction R, the flat items G conveyed by a conveying device T can be conveyed and inserted into the compartments F1, F2, while the stacking wheels 10, 20 rotate at the same rotational speed in the rotational direction R. The stacking wheels 10, 20 convey the flat items G located in the compartments F1, F2 to a support 31. The device 1 for stacking flat items G also has one or more strippers 30, which are arranged laterally next to the stacking wheels 10, 20 and strip out flat items G conveyed in the compartments F1, F2, that is to say remove them from the compartments F1, F2 so that the flat items G are received on the support 31 and form a stack 40 of flat items G. If particularly large stacks have to be formed, the support 31 can be movable in the direction of the arrow 32 so that the support 31, or the stack 40 formed thereon, does not collide with the stacking fingers S1, S2.

Figure 3A:
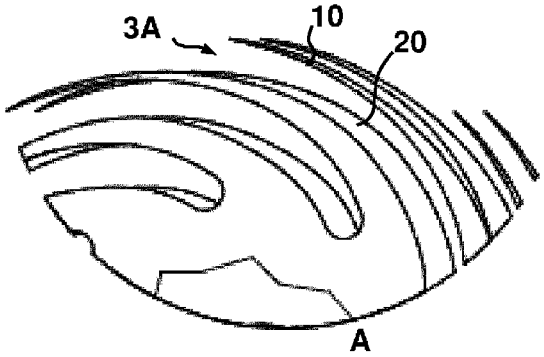
FIGS. 3A to 3C show enlarged details of the device for stacking flat items from FIG. 2.
Figure 3B:
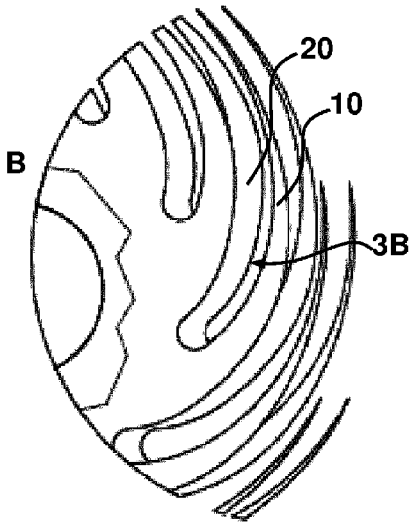
Figure 3C:
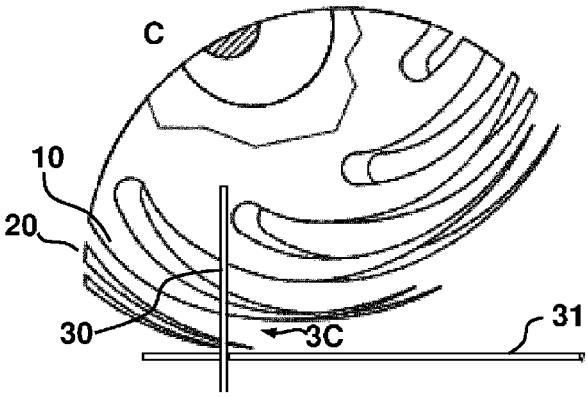

FIGS. 3A to 3C show enlarged representations of the details A, B and C marked in FIG. 2.

As can be seen from FIG. 3A, in the region of detail A, a maximum opening 3A for the compartments of the stacking wheels 10 and 20 located at this point results between the stacking fingers of the first stacking wheels 10 and the second stacking wheels 20. As can be seen from FIG. 2, the flat items G are conveyed from the conveying system T into the compartments F1. F2 of the stacking wheels 10, 20 at the location of the maximum opening 3A in the compartments F1, F2 of the first and second stacking wheels 10, 20. This means that the flat items G can be inserted into the compartments F1, F2 without the risk of colliding with the stacking fingers S1. S2, since the compartments have the maximum opening 3A at this point of the outer circumference of the stacking wheels.

It can be seen from FIG. 3B that, in the region of the detail B, a minimum opening 3B in the compartments F1, F2 results after a rotation by 90°. This means that the flat items G at this point of the minimum opening in the compartments F1, F2 are clamped by the stacking fingers S1, S2 or are at least subjected to a force. The continuous reduction of the opening in the compartments F1, F2 while the stacking wheels 10, 20 rotate in the direction of rotation R and at the same speed makes it possible to brake the flat items G conveyed by the conveying device T into the compartments F1, F2 of the stacking wheels 10, 20, without abruptly applying larger forces to the flat items G or the edges thereof, which forces could possibly result in damage to the flat items.

After a further rotation by 90°, a maximum opening 3C for the compartments of the stacking wheels 10 and 20 located at this point is again obtained in the region of the detail C, as shown in FIG. 3C. In this way it is made possible for the stripper 30 to remove, without much resistance, the flat items G located in the compartments of the stacking wheels 10 and 20 by means of the stacking fingers S1, S2 of the stacking wheels 10 and 10, so that the items are received on the support 31.

The above-described change in the opening between the compartments F1, F2 of the first and second stacking wheels 10, 20 while they rotate in the rotational direction R results from the arrangement of the two shafts 12, 22 of the device 1 in the axial direction parallel to one another, with the central points 11 and 21 of the first shaft 12 and the second shaft 22 lying in the plane E and having the distance d from one another. This arrangement of the shafts 12, 22 of the stacking wheels 10, 20 results in a maximum opening in the compartments F1, F2 of the first and second stacking wheels 10, 20 whenever the compartments F1, F2 are oriented parallel to the plane E in which the central points 11, 21 of the shafts 12, 22 lie. A minimum opening in the compartments F1, F2 during the rotation in the rotational direction R of the first and second stacking wheels 10, 20 results whenever the compartments F1, F2 are oriented perpendicular to the plane E. In the embodiment shown in the drawings, the plane E is perpendicular and horizontal in the plane of representation. This results in maximum openings in the compartments F1, F2 of the first and second stacking wheels 10, 20 in the case of a horizontal orientation of the compartments F1, F2 of the two stacking wheels 10, 20 in the region of the conveying device T (detail A) and the stripper 30 (detail C). Accordingly, minimum openings in the compartments F1, F2 of the first and second stacking wheels 10, 20 result in the case of a vertical orientation of the compartments F1, F2 of the two stacking wheels 10, 20 in the region of the toothed belt 13 and of the detail C. Or, in other words, the resulting overall geometry of the opening between the first and second compartments F1, F2 depends on the angular position of the first and second stacking wheels 10, 20, wherein portions of the opening between the first and second compartments F1, F2, which in the respective angular positions are perpendicular to the plane E, are constricted by the distance d (minimum opening), whereas portions of the opening between the first and second compartments F1, F2 which are parallel to the plane E are unchanged (maximum opening). At all other angular positions at which the portions of the opening between the first and second compartments F1, F2 are not exactly parallel or perpendicular to plane E, the opening has a value which is between the minimum and maximum value of the opening.

The maximum opening corresponds to the smallest opening in one of the compartments F1 or F2. The minimum opening results from the smallest opening in one of the compartments F1 or F2 minus the distance d of the central points 11, 21 from the first and second shaft 12, 22. If, for example, the compartments F1 and F2 of the first and second stacking wheels 10 and 20 each have a continuous opening with a width of 5 mm and the distance d is 4 mm, a maximum opening of 5 mm and a minimum opening of 1 mm result.

The compartments of the stacking wheels 10, 20 shown in FIGS. 1 and 2 have a curved profile. Deviating from this, the compartments can also have a rectilinear, helical or other profile. The profile of the compartments is advantageously adapted to the properties of the flat items G to be stacked. If the flat items G are, for example, flexible and slightly bendable or deformable, it may be expedient to choose a more highly curved or helical profile for the compartments. If the flat items G are, for example, rigid and only slightly or hardly bendable or deformable, it may be expedient to choose a rectilinear or only slightly curved profile for the compartments.

In the embodiment described with reference to the drawings, the first and second stacking wheels 10 and 20 are of the same design. The first and second stacking wheels 10 and 20 can also be of different design. For example, the first stacking wheels 10 can have compartments F1 and stacking fingers S1, which are dimensioned differently and/or have a different profile than the second stacking wheels 20 and their compartments F2 and stacking fingers S2. What is crucial in the design of the first and second stacking wheels are the above-mentioned properties of the flat items to be stacked, as well as the consideration of the above-described attachment of the first and second stacking wheels 10 and 20 to the first and second shaft 12 and 22 such that the profile of the first and second compartments F1 and F2 is congruent to the extent that, in the region of the conveying device T there is the maximum opening in the compartments F1 and F2, so that the flat items G can be conveyed into the compartments F1 and F2. The same applies to the region of the stripper 30 in which the flat items G are removed from the compartments F1 and F2. As described above, as is also the case for a different design of stacking fingers and compartments of the first and second stacking wheels 10 and 20, the minimum opening in the compartments F1 and F2 is created in the regions which are in each case at a distance from the regions of the conveying device T and the stripper 30 by 90° in the rotational direction R.

In addition, the stacking wheels 10, 20 can be mounted on their respective shafts 12, 22 so as to be slightly rotated relative to one another. In this case, the resulting openings in the compartments F1, F2 are reduced according to the rotation of the stacking wheels 10, 20. However, this causes a further increase in the braking effect of the stacking wheels 10, 20 on the flat items to be stacked.

Furthermore, the first and second stacking wheels 10 and 20 or their stacking fingers S1 and S2 can be produced from the same or different materials. For example, the first stacking wheels 10 or the stacking fingers S1 thereof can be produced from a relatively rigid, slightly flexible material, e.g., aluminum, whereas the second stacking wheels 20 or the stacking fingers S2 thereof can be produced from a more flexible material, e.g., PMMA. In this case, the dimensions of the compartments F1 and F2 can be defined such that the resulting minimum opening is smaller than the thickness of the flat items to be stacked. It can also be the case that a negative value results for the minimum opening. For example, the two compartments F1 and F2 can have an opening with a width of 3 mm and the distance d of the central points 11, 21 of the shafts 12, 22 can be 4 mm. As a result, for the maximum opening of a value of 3 mm, a value of −1 mm is obtained for the minimum opening, i.e., the stacking fingers S1, S2 of the first and second stacking wheels 10, 20 intersect. In this case, by selecting different material for the stacking fingers S1, S2 of the first and second stacking wheels 10 and 20, the flat items G to be stacked are braked or clamped particularly strongly between the flexible and rigid fingers S2 and S1 of the first and second stacking wheels 10 and 20 in the region of the minimum opening—which is then, as described above, negative—and the flexible stacking fingers S2 of the second stacking wheel 20 deform. The flat items are thereby conveyed particularly securely in the stacking wheel and a stack is formed particularly precisely.

If flexible flat items G are stacked, is it also possible to use the above-described dimensioning of the compartments F1, F2 of the first and second stack edges 10, 20—which leads to a minimum opening which is less than the flat items G to be stacked or is negative—for rigid stacking fingers S1 and S2 for the first and second stacking wheels 10 and 20, since in this case the flat items G are deformed in the region between the first and second stacking wheels 10, 20.

Furthermore, the stacking fingers S1, S2 of the first and/or second stacking wheels 10, 20 can be equipped with a soft, sliding or rolling surface in order to influence the braking effect on the flat items G conveyed into the compartments F1, F2 and to minimize the acting forces during the displacement of the stacking fingers S1, S2 relative to one another while the stacking wheels 10, 20 rotate. Corresponding properties are exhibited, for example, by materials such as low-friction plastics, e.g., polyethylene terephthalate (PET), polyoxymethylene (POM), polyamides and polytetrafluoroethylene (PTFE), but also rubber-like materials such as ethylene-propylene-diene rubber (EPDM) or silicones, or even brush-like surface structures.

In the embodiment shown in the drawings, two first stacking wheels 10 and two second stacking wheels 20 are provided in each case. However, it is evident that it is also possible to use only a first and a second, or more than two first and second stacking wheels 10 and 20, as long as the compartments F1 and F2 of the stacking wheels 10 and 20, as described above, are oriented such that the flat items G can be conveyed from the conveying device T into the compartments F1 and F2 of the stacking wheels 10 and 20.

It is also evident that the arrangement of the first and second shafts 12 and 22 used can be of different design from the embodiment shown in the drawings as long as the above-described distance d between the shafts can be established and the central points 11, 21 of the shafts 12, 22 lie in one plane. In contrast to the embodiment shown in FIG. 2, the plane E does not have to be horizontal in the plane of representation, but can have any desired deviation. If the shafts 12, 22 are arranged, for example, such that their central points 11, 21 span a plane that deviates by 30° relative to the illustrated plane E, the details A, B and C are displaced by 30° counter to the rotational direction R.

A force-exerting element F, for example a spring, can be arranged between the shafts 12, 22 of the stacking wheels 10, 20. In this case, the spring F causes the shafts 12, 22 to be pulled toward or pushed away from one another. One of the shafts 12, 22 can also have a fixed position. As a result of the force of the spring F in cooperation with the shafts 12, 22 which are offset by the distance d, a force is applied via the shafts 12, 22 to the flat items G to be stacked over the course of one revolution of the stacking wheels 10, 20. This increases the frictional force between the flat items G to be stacked and the stacking fingers S1, S2 of the stacking wheels 10, 20, which results in a further adjustment option for the clamping and/or frictional forces acting on the flat items G to be stacked.

As described at the outset, the flat items G can be electrode elements for producing electrochemical energy stores, such as lithium-ion batteries, or energy converters such as fuel cells. These have anodes and cathodes as well as separators or membranes, which are individually stacked or stacked as cells, as described for example in WO 2020/212316 A1 or WO 2020/212317 A1. A predetermined number of anodes and cathodes as well as separators or membranes or D cells must be stacked in order to be able to form an energy store or an energy converter. This can be achieved particularly advantageously by means of the device described above.

The device described above is also suitable for other delicate and easily damaged flat items, such as bank notes, for forming stacks of corresponding flat items.

The invention claimed is:

1. A device for stacking flat items, having stacking wheels and stacking fingers and compartments located between the stacking fingers for receiving flat items to be stacked, a conveying device for conveying the flat items into the compartments of the stacking wheels, a stripper for removing the flat items from the compartments of the stacking wheels, a support for receiving the flat items removed from the compartments of the stacking wheels and for forming a stack of flat items, wherein at least one first stacking wheel mounted on a first shaft and at least one second stacking wheel mounted on a second shaft, wherein the shafts of the stacking wheels are parallel to each other in an axial direction and arranged at a distance d from each other so that a central point of the first shaft and a central point of the second shaft lie in a plane, wherein the first and the second stacking wheel are driven at the same speed and in the same rotational direction so that a resultant opening between the first and second compartments is created depending on the angular position of the first and second stacking wheels, wherein portions of the opening between the first and second compartments, which in the respective angular positions are perpendicular to the plane, are constricted by the distance d, whereas portions of the opening between the first and second compartments which are parallel to the plane are unchanged with respect to their opening width.

2. The device for stacking flat items according to claim 1, wherein the compartments of the first and second stacking wheels have a curved, rectilinear or helical profile along their profile or along a portion thereof.

3. The device for stacking flat items according to claim 1, wherein at least one stacking wheel or at least the stacking finger thereof consists of a rigid material.

4. The device for stacking flat items according to claim 1, wherein at least one stacking wheel or at least the stacking finger thereof consists of a flexible material.

5. The device for stacking flat items according to claim 1, wherein the first and second stacking wheels are of the same design.

6. The device for stacking flat items according to claim 1, wherein the first and second stacking wheels are of different design.

7. The device for stacking flat items according to claim 1, wherein an element, in particular a spring, is arranged between the first and second shaft and exerts a force which acts between the first and second shaft.

8. The device for stacking flat items according to claim 1, wherein the compartments of the first and second stacking wheels, or at least portions thereof, have an opening with a width that is greater than or equal to the distance d and a thickness of the flat items to be stacked.

9. The device for stacking flat items according to claim 1, wherein the compartments of the first and second stacking wheels, or at least portions thereof, have an opening with a width that is smaller than the distance d and a thickness of the flat items to be stacked.

* * * * *